United States Patent [19]

Hyytinen

[11] 4,229,156

[45] Oct. 21, 1980

[54] APPARATUS FOR MAKING CONCRETE BRICK HAVING ANTIQUE APPEARANCE

[75] Inventor: Niilo M. Hyytinen, Reno, Nev.

[73] Assignee: ABC Concrete Products, Reno, Nev.

[21] Appl. No.: 3,577

[22] Filed: Jan. 15, 1979

Related U.S. Application Data

[62] Division of Ser. No. 919,529, Jun. 26, 1978, Pat. No. 4,178,340.

[51] Int. Cl.[3] ..... B28B 3/04; B28B 5/04

[52] U.S. Cl. ..... 425/145; 425/253; 425/452; 425/DIG. 118

[58] Field of Search ..... 425/91, 106, 134, 220, 425/253, 257, 130, 254, 255, 452, 145, DIG. 118; 264/74, 76, 256

[56] References Cited

U.S. PATENT DOCUMENTS

| | | | |
|---|---|---|---|
| 1,280,575 | 10/1918 | Stehm | 425/257 X |
| 1,704,193 | 3/1929 | Hoffman . | |
| 1,739,379 | 12/1929 | Stead . | |
| 2,020,137 | 11/1935 | Damhorst . | |
| 2,446,782 | 10/1948 | Otis | 264/256 X |
| 2,623,382 | 10/1952 | Denison | 264/256 X |
| 3,425,105 | 2/1969 | Gulde . | |
| 3,621,086 | 11/1971 | Gulde . | |
| 3,939,238 | 2/1976 | Salts . | |

*Primary Examiner*—Thomas P. Pavelko

*Attorney, Agent, or Firm*—Dowell & Dowell

[57] ABSTRACT

An apparatus for making concrete brick in a manner such that at least both elongated sides of the brick have an antique appearance. In the apparatus a first hopper is provided which discharges coloring material onto an empty pallet that passes below the same. The pallet is moved into a concrete brick-making machine where a plurality of bricks are formed on their sides with the lowermost side in engagement with the coloring material. Thereafter a second hopper discharges coloring material onto the upper side of the bricks and such coloring material on the top is spread lengthwise. The forming of the bricks on the coloring material on the pallet provides a mottled effect on one side of the brick and the spreading of the coloring material provides a streaked effect on the other side so that a different antique appearance is imparted to opposite sides of the brick.

5 Claims, 7 Drawing Figures

APPARATUS FOR MAKING CONCRETE BRICK HAVING ANTIQUE APPEARANCE

This is a division, of application Ser. No. 919,529, filed June 26, 1978, now U.S. Pat. No. 4,178,340.

BACKGROUND OF THE INVENTION

1. Field of the Invention

This invention relates to molding plastic materials of different kinds and relates particularly to molding concrete bricks having an antique appearance.

2. Description of the Prior Art

Heretofore many efforts have been made to provide a coating of coloring material on one or more surfaces of a brick or tile of ceramic, clay, concrete or other base material and these efforts have included painting or spraying the coloring material on the base material, forming a liquid mixture of the coloring material and pouring such mixture on the base material, and coating the vertical walls of the mold with coloring material before introducing the base material. In some cases the coloring material has included several colors which are applied indiscriminately, while in other cases different colors have sharply defined edges when applied to the base material. These prior methods and structures have been time consuming since they required substantial hand operations for mixing, painting or spraying one or more exterior surfaces of the base material, and have been wasteful of the coloring material when the walls of the molds have been coated.

Some examples of the prior art which utilize painting or spraying of the base material are U.S. Pat. Nos. 1,638,108 to Barnes-Thomas and 3,939,238 to Salts. Some examples of the prior art which coat the walls of a mold are U.S. Pat. Nos. 1,704,193 to Hoffman; 1,739,379 to Stead; 1,984,059 to Dandini; 2,020,137 to Damhorst; 3,425,105 and 3,621,086 to Gulde.

SUMMARY OF THE INVENTION

This invention is embodied in apparatus for making concrete bricks having an antique appearance in which dry coloring material is spread onto a pallet and thereafter such pallet passes into a concrete brick-making machine of conventional construction which molds a plurality of bricks on their sides. Preferably two rows of bricks are formed on each pallet. When the bricks are being formed in the brick-making machine, the liquid in the concrete saturates the coloring material which has been spread on the pallet causing a mottled effect. After the bricks have been formed, the pallet advances along a conveyor and operates a hopper discharge mechanism which causes additional dry coloring matter to be discharged onto the upper sides of the bricks. After the material has been placed on the upper side of the bricks, a roller or rotating brush engages the upper surface of the bricks and spreads the coloring material as the bricks pass therebelow causing a streaked appearance lengthwise of the bricks. Subsequently a spray of water is sprayed onto the bricks to cause the dry coloring material on the upper side to be saturated and to adhere to the upper edge of the bricks. Thereafter the pallets are transported to a holding station where they may be cured in a kiln or air dried.

It is an object of the invention to provide an apparatus for making concrete bricks in which a plurality of rows of bricks are formed on their sides and apparatus is provided for applying antique coloring material to opposite sides only of the bricks. After the coloring material has been applied, the coloring material on one side is streaked while the other side has a mottled appearance.

DESCRIPTION OF THE PREFERRED EMBODIMENT

Figure 1:
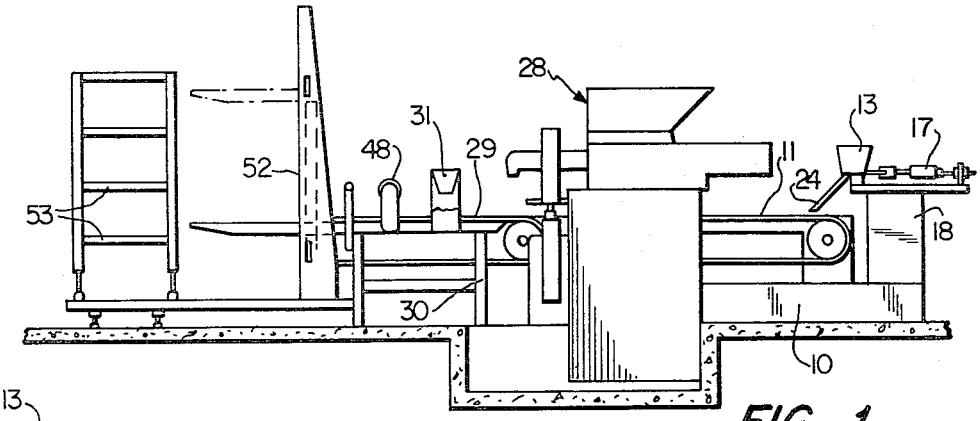
FIG. 1 is a side elevation of a concrete brick manufacturing apparatus in accordance with the present invention.
Figure 3:
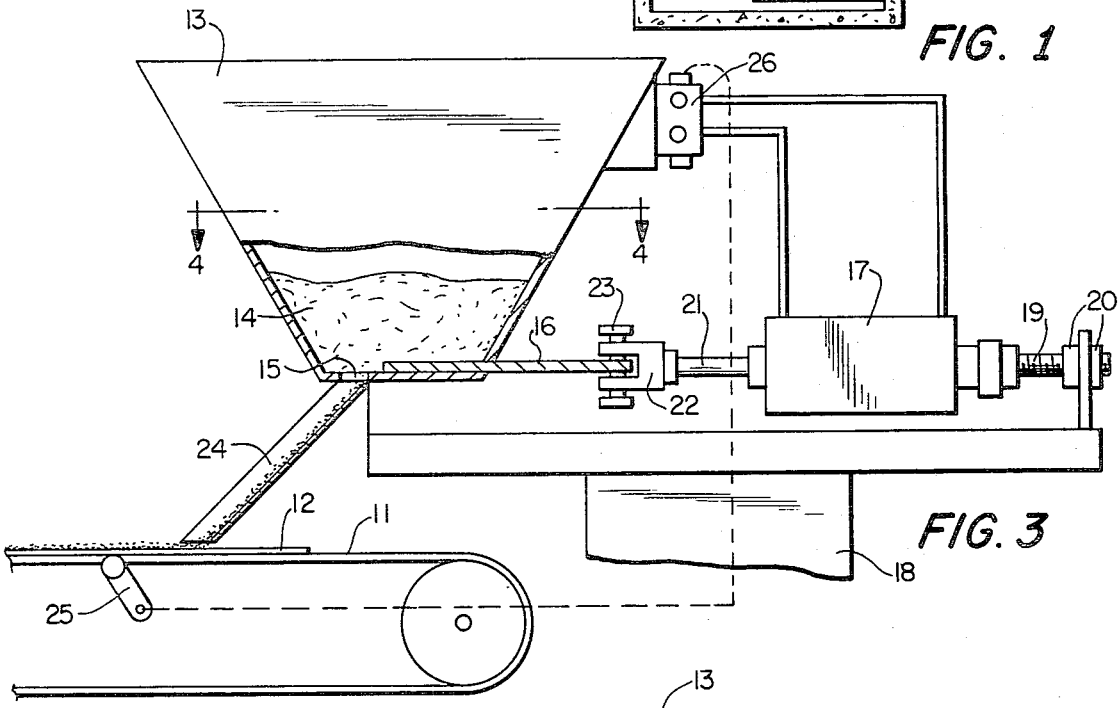
FIG. 3 is a side elevation of the apparatus for applying coloring material to the upper surface of a pallet.
Figure 4:
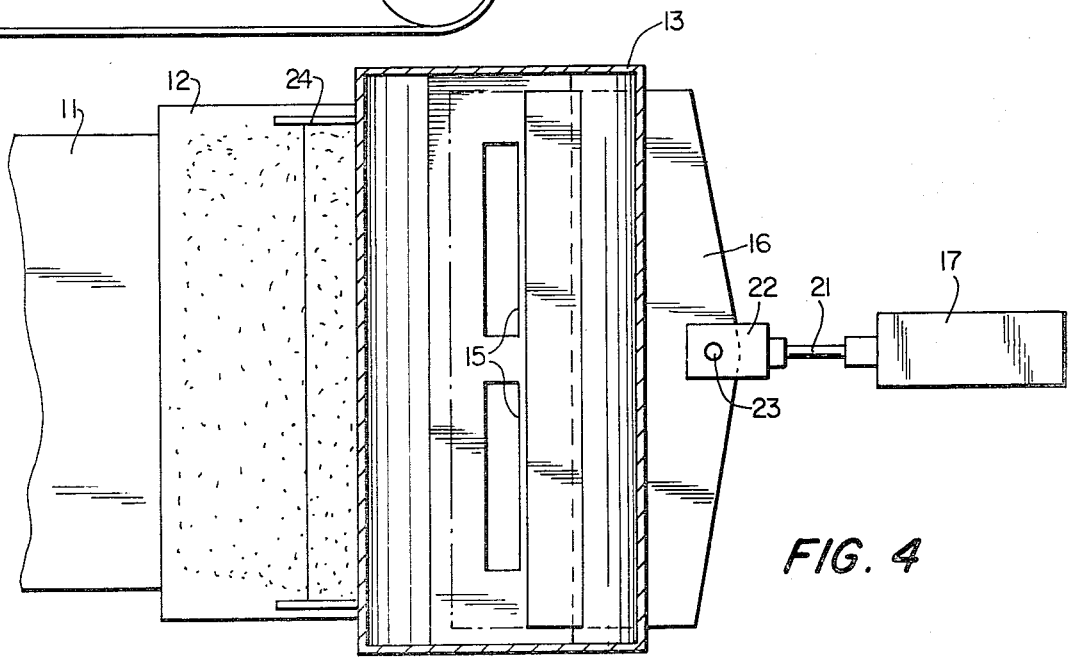
FIG. 4 is a section on the line 4—4 of FIG. 3.
Figure 2:
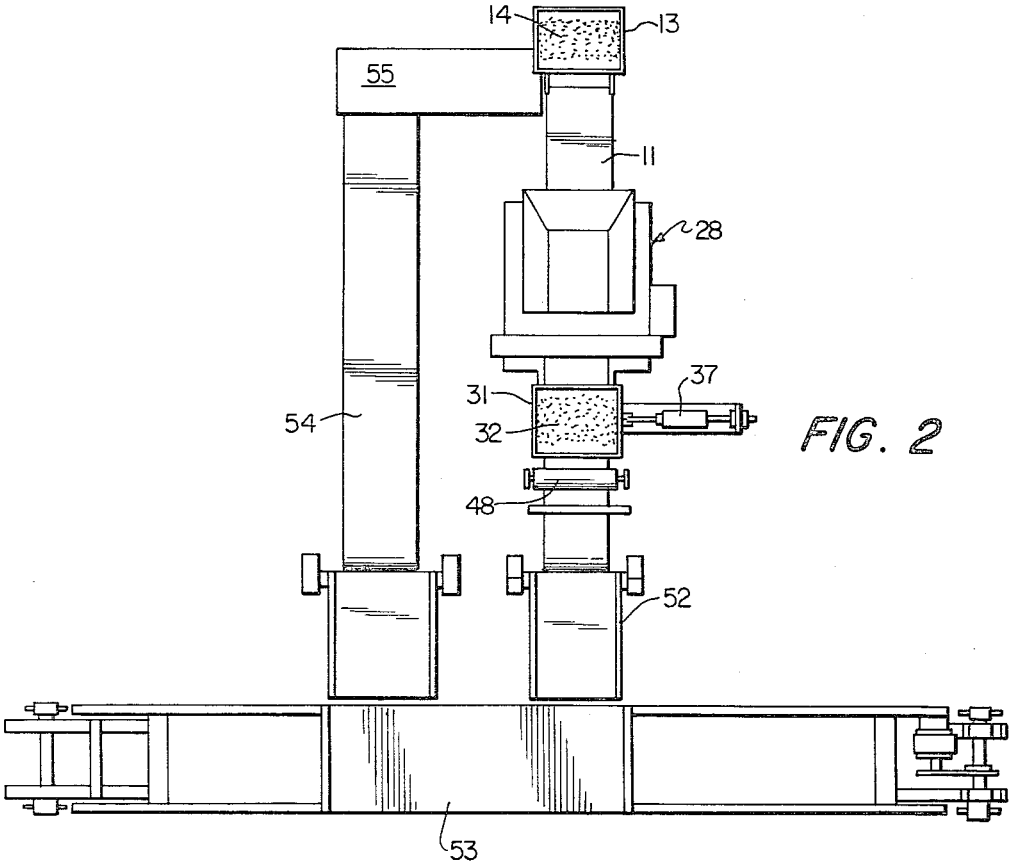
FIG. 2 is a top plan view thereof.
Figure 5:
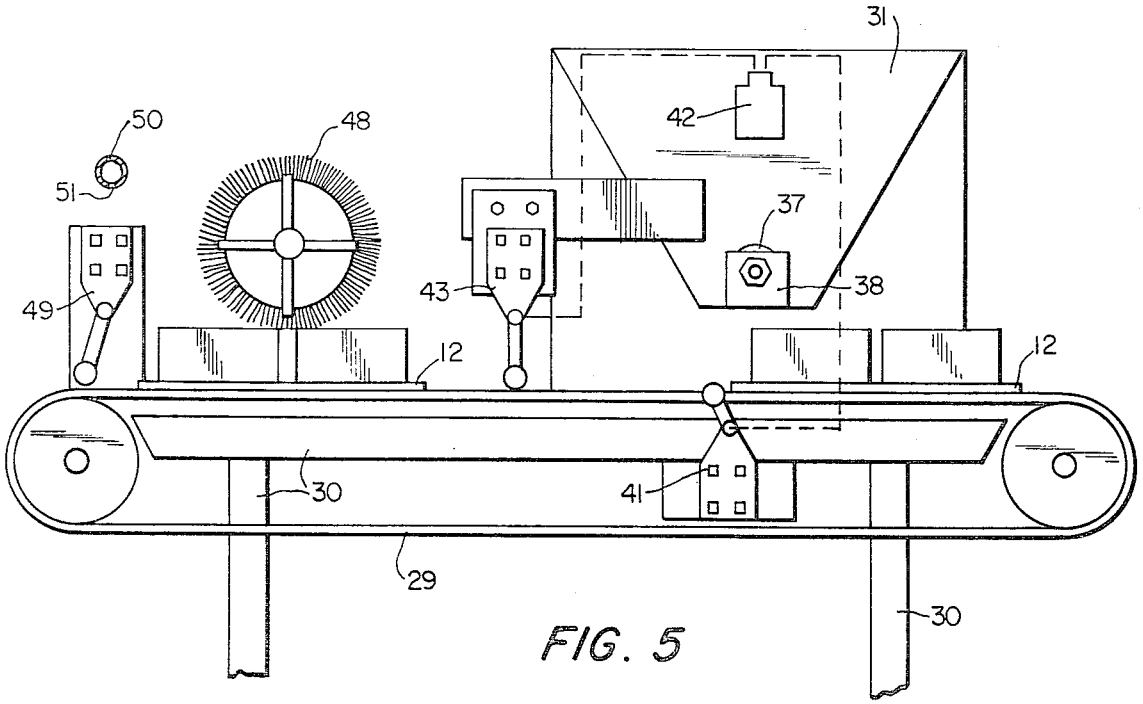
FIG. 5 is a side elevation of the apparatus for applying coloring material to the upper sides of the bricks.

With continued reference to the drawings, a base 10 is provided on which an endless inlet conveyor 11 is mounted. A series of pallets 12 are placed one at a time on one end of the inlet conveyor 11 and the inlet conveyor is moved intermittently so that the pallets are moved from right to left, as shown in FIG. 1. A hopper 13 is positioned above the inlet conveyor 11 and such hopper contains a dry mixture 14 of coloring material such as white cement and red oxide or the like. The hopper includes a pair of laterally elongated discharge openings 15 at the bottom and such openings normally are closed by a slide plate 16.

In order to operate the slide plate when desired, a fluid cylinder 17 is mounted on a supporting structure 18 by means of a threaded bolt 19. Adjusting nuts 20 are provided on the bolt to vary the location of the cylinder 17. The cylinder includes a piston rod 21 the outer end of which is connected to a clevis 22 which in turn is connected by a bolt 23 to the slide plate 16 so that when the cylinder moves the piston rod in one direction, the slide plate uncovers the discharge openings 15 and when the piston rod is moved in the opposite direction, the slide plate again closes such discharge openings. When the slide plate 16 is moved to open the discharge openings, a portion of the dry mixture 14 is discharged through the openings 15 onto a downwardly inclined chute 24 the lower end of which terminates just above the inlet conveyor 11.

A trigger or switch mechanism 25 is located adjacent to the inlet conveyor in a position to be engaged by a pallet 12 as the conveyor moves the pallet along. The trigger or switch mechanism 25 is located in a position such that the leading edge of the pallet 12 engages the trigger just after such leading edge passes under the chute 24. Operation of the trigger activates a solenoid operated distributor valve 26 which introduces fluid under pressure into the cylinder 17 and causes the plate 16 to slide rearwardly so that a predetermined quantity of dry mixture 14 passes through the discharge openings 15 and slides down the chute by gravity. Thereafter, the distributor valve 26 is operated automatically to reverse the flow of fluid to the cylinder 17 and to close the openings. The dry material which is discharged from the chute is spread onto the upper surface of the pallet as the pallet moves under the chute.

After the dry material has been spread on the pallet, the inlet conveyor 11 is halted and a second pallet is placed on the inlet end of the conveyor 11. Thereafter the inlet conveyor is started and the second pallet engages the trigger 25 to cause dry material to be spread onto the upper surface of the second pallet while the first pallet advances into a conventional concrete brick-making machine 28. In this position a mold which is located within the concrete brick-making machine 28 and which includes a plurality of rows of cavities is either moved into engagement with the pallet or the pallet is moved into engagement with the mold. In either case, the mold engages the upper surface of the pallet and thereafter moldable concrete or other hardenable material is poured into the cavities of the mold so that the cavities are filled.

It is noted that the cavities in the mold are approximately $7\frac{5}{8}$ inches long, $2\frac{1}{2}$ inches wide and $3\frac{5}{8}$ inches high to form standard sized bricks B in a position such that the bricks are arranged on their sides. Since the concrete bricks B are molded on top of the dry mixture which is located on the upper surface of the pallet, the liquid of the concrete saturates the dry mixture and causes such mixture to have a mottled appearance. The concrete used to mold the bricks B is a relatively dry mixture and after such mold has been filled, the concrete is compressed or tamped while the mold is being vibrated and thereafter the bricks are stripped from the mold.

The pallet on which the bricks have been molded is then advanced onto a discharge conveyor 29, while a second pallet is advanced into the concrete brick-making machine and another pallet passes under the chute 24. The discharge conveyor 29 is mounted on a base or frame 30 located adjacent to the brick-making machine 28 and may be operated intermittently in timed relationship with the inlet conveyor 11 or may be operated continuously.

As the pallet 12 carrying the molded bricks moves along the discharge conveyor, such bricks pass immediately below the discharge openings of a hopper 31 containing a dry mixture 32 of a coloring material such as white cement and oxide. The coloring material of the mixture 32 may be substantially the same as the coloring material of the mixture 14, or if desired the coloring mixture 32 may be different from the mixture 14 to impart a different color to the upper side of the bricks.

The hopper 31 is provided with a plurality of generally rectangular discharge openings 33 in the bottom portion thereof which are arranged longitudinally of the direction of movement of the bricks and substantially in vertical alignment therewith. The openings 33 normally are closed by a slide plate 34 having a plurality of openings 35 which may be moved laterally into registration with the openings 33 when it is desired to discharge a predetermined quantity of the coloring mixture 32 onto the upper sides of each row of bricks. The slide plate 34 is connected to a piston rod 36 of a fluid cylinder 37 and such fluid cylinder is mounted on a supporting structure 38 by means of a threaded bolt 39. A pair of adjusting nuts 40 are provided on the threaded bolt 39 to locate the cylinder in a position whereby the slide plate may be moved to a position in which the openings 33 in the bottom of the hopper are entirely closed when the piston rod is moved in one direction and are open when the piston rod is moved in the opposite direction.

When two or more rows of bricks are molded on a pallet, the slide plate 34 should be operated momentarily as each row passes the discharge openings 33 to discharge a predetermined quantity of coloring material on each brick after which the openings 33 again are closed until the next row of bricks is located below the discharge openings.

Figure 6:
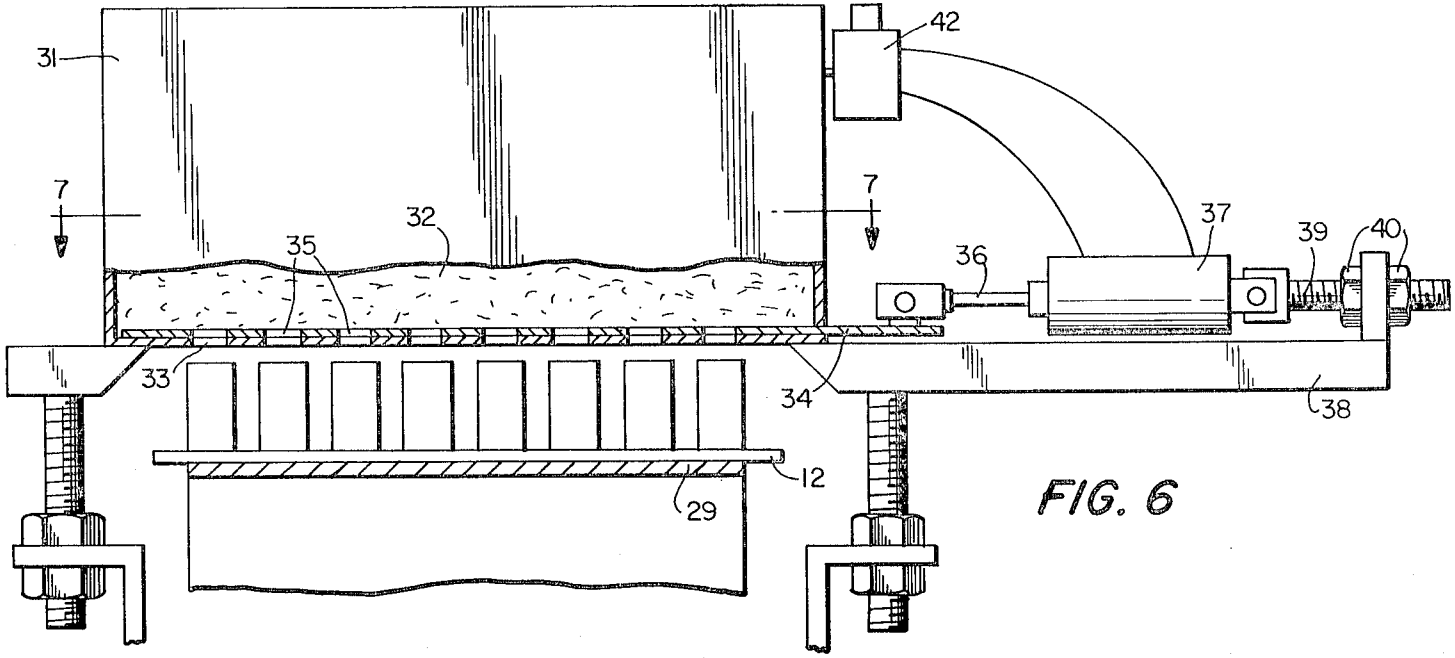
FIG. 6 is an enlarged section taken on the line 6—6 of FIG. 5.
Figure 7:
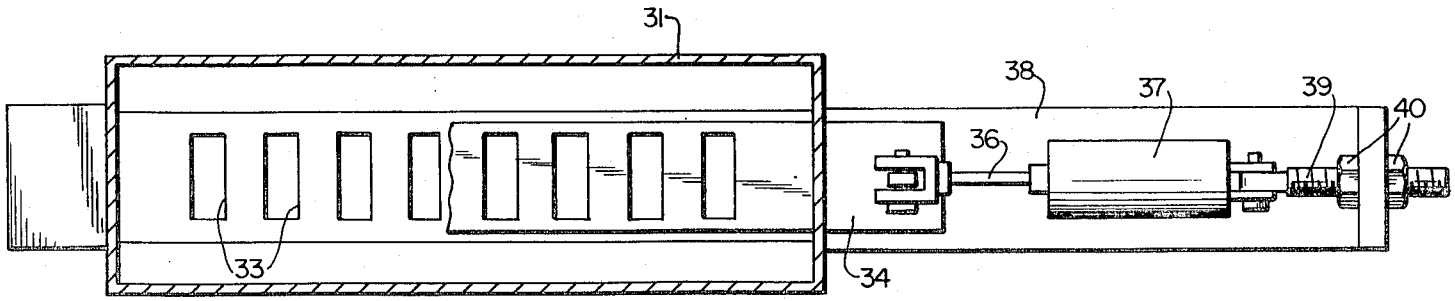
FIG. 7 is a section on the line 7—7 of FIG. 6.

In order to operate the fluid cylinder 37 to discharge a quantity of dry mixture 32 onto the upper side of the first row of bricks, a trigger or switch mechanism 41 is mounted on the base 30 and such trigger is located in a position to be engaged by the leading edge of each of the pallets 12 as the pallets are moved by the discharge conveyor 29. The trigger 41 activates a solenoid operated distributor valve 42 of conventional construction to cause fluid under pressure to enter one end of the fluid cylinder so that the piston rod is operated to move the slide plate 34. When the openings 33 have been open for a predetermined length of time, the distributor valve 42 is operated automatically to direct fluid under pressure into the other end of the cylinder to move the slide plate 34 to a position closing the openings 33. Normally when the piston rod is in the retracted position, the slide plate 34 is moved so that the openings 33 in the bottom of the hopper 31 are closed, and when the piston rod is extended, as illustrated in FIG. 6, the openings 35 in the slide plate are in registration with the openings 33 of the hopper so that the dry mixture 32 is discharged through the aligned openings onto the upper surface of the bricks.

When the second row of bricks on the pallet 12 is located below the hopper 31, a second trigger or switch mechanism 43 is engaged by the leading edge of the pallet and moved to an operating position. The trigger 43 is electrically connected to the solenoid operated distributor valve 42 which causes operation of the fluid cylinder 37 to again move the slide plate 34 so that a predetermined quantity of dry mixture 32 is discharged onto the second row of bricks.

The pallet 12 then moves the bricks under a rotating brush 48 which is driven in any desired manner (not shown). The brush 48 engages the dry coloring material that has been deposited on the upper sides of the bricks and spreads such dry material along the entire length of the bricks and simultaneously imparts a streaked appearance thereto. Instead of the brush 48, it is noted that a roller or other rotating member could engage and spread the dry material on the upper sides of the bricks. Thereafter the leading edge of the pallet 12 engages a trigger or switch mechanism 49 which energizes a water pump (not shown) to cause water under pressure to enter a header 50 located above and transversely across the discharge conveyor 29 so that a fine mist of water is sprayed through openings 51 in the header onto the upper surfaces of the bricks B to saturate the coloring mixture on the upper surface thereof.

After the coloring material on the upper surface of the brick has been saturated, the pallet carrying the bricks B is moved onto an elevator 52 which raises or lowers the pallet so that the pallet is aligned with a shelf 53 of a portable rack or dolly 54. The pallet 12 is transferred from the elevator 52 to the shelf 53 by a pusher bar (not shown) or other conventional transfer means. After the shelves 53 of the portable rack have been filled, the rack is moved to a drying kiln for curing, or if desired the rack could be moved to a storage area where the bricks are air cured. When curing has been completed, the bricks B are removed from the pallets and such pallets are placed on a return conveyor 54 located adjacent to the apparatus. Such return conveyor moves the pallets to a cleaning station 55 where the residue is removed from the pallets and thereafter the pallets can be reintroduced onto the inlet conveyor.

In the operation of the device, pallets 12 are placed one at a time on an inlet conveyor so that when the conveyor is operated such pallets are moved lengthwise of the apparatus. During the movement of the pallets, each pallet engages a trigger mechanism which operates a fluid cylinder to open the slide plate 16 of a first hopper 13 in which a dry coloring material or mixture 44 is disposed. When the slide plate is operated, coloring material is discharged through a pair of openings 15 onto an inclined chute 24 which spreads the coloring material as the coloring material moves down the chute by gravity. Since the pallet is moving when the coloring material is being discharged from the chute, such coloring material is spread substantially entirely across the upper surface of the pallet and from the leading edge to the trailing edge thereof.

The pallet then is moved to a concrete brick-making machine 28 of conventional construction which forms a plurality of bricks on the coloring material carried by the upper surface of the pallet. Even though the concrete is a relatively dry mixture, there is sufficient moisture present to saturate the dry coloring material and impart a mottled appearance thereto. In the concrete brick-making machine, the forming mold is vibrated which causes the moisture within the concrete to flow downwardly and insure that the coloring material is saturated. After the mold has been stripped from the bricks, the pallet is moved onto a discharge conveyor 29 which carries the pallet and the bricks that have been molded thereon underneath a second hopper 31 containing dry coloring material.

As the pallet passes under the second hopper, the leading edge of the pallet engages a first trigger to momentarily operate a slide plate 34 and permit dry coloring material to be discharged onto the upper surface of the first row of bricks, after which the openings of the hopper are closed. When the second row of bricks is aligned with the openings in the hopper, the leading edge of the pallet engages another trigger 43 to again open the slide plate 34 and permit coloring material to be discharged onto the upper surface of the second row of bricks. Thereafter the pallet moves the bricks under a material spreading device such as a brush or roller 48 which spreads the coloring material along the upper side of each of the bricks and imparts a streaked appearance to the coloring material. The pallet then engages another trigger 49 which operates a water spraying device 50 to spray water onto the upper surfaces of the bricks and saturate the coloring material thereon. Thereafter the pallet and the bricks are cured either in a kiln or by air curing.

It is noted that the coloring material of the first hopper may be substantially the same as the coloring material of the second hopper, or such materials may be different from each other. When the opposite sides of the bricks are of different colors, such bricks may be either oriented so that the sides are in the same direction, or alternate courses of the bricks may be reversed, or if desired the bricks may be laid indiscriminately depending upon the effect desired. Also, one side of the brick has a mottled effect and the other side has a striped effect. It is noted that, if desired, the first and second hoppers may periodically be supplied with different color mixtures so that the mottled and striped effects of one batch of bricks are different from the effects of a second batch.

I claim:

1. In an apparatus for making bricks which includes a molding means having a mold and supply of liquefied hardenable material, the improvement comprising inlet and outlet conveyor means associated with said molding means, at least one pallet carried by said conveyor means, a first hopper located adjacent to said inlet conveyor means and containing a first supply of flowable coloring material, first dispensing means for selectively discharging coloring material from said first hopper onto said pallet as said inlet conveyor means moves said pallet past said first hopper, said brick making apparatus including a mold and means to position said mold in engagement with said pallet to mold at least one brick on said pallet with one side of said brick engaging said coloring material and means to remove said mold from said pallet, a second hopper located adjacent to said outlet conveyor means and containing a second supply of flowable coloring material, second dispensing means for selectively discharging coloring material from said second hopper onto the opposite side of said brick carried by said pallet, and means for saturating said second coloring material on said brick, whereby coloring material is applied substantially to opposite sides only of said brick.

2. The structure of claim 1 including means for spreading said second coloring material on said opposite side of said brick.

3. The structure of claim 1 in which each of said first and second dispensing means includes a slide plate operated by a fluid cylinder.

4. The structure of claim 1 in which said first dispensing means includes an inclined chute.

5. The structure of claim 1 in which each of said first and second dispensing means is controlled by switch means which is operated by said pallet.

* * * * *